US008590532B2

(12) United States Patent
Forbes et al.

(10) Patent No.: US 8,590,532 B2
(45) Date of Patent: Nov. 26, 2013

(54) FILTRATION MASK

(75) Inventors: Steven John Forbes, Wiltshire (GB); Matthew James Hodgson, Wiltshire (GB)

(73) Assignee: Avon Polymer Products Limited, Melksham, Wiltshire (GB)

( * ) Notice: Subject to any disclaimer, the term of this patent is extended or adjusted under 35 U.S.C. 154(b) by 447 days.

(21) Appl. No.: 12/681,395

(22) PCT Filed: Oct. 1, 2008

(86) PCT No.: PCT/GB2008/003320

§ 371 (c)(1),
(2), (4) Date: Sep. 14, 2010

(87) PCT Pub. No.: WO2009/044131

PCT Pub. Date: Apr. 9, 2009

(65) Prior Publication Data

US 2011/0011404 A1 Jan. 20, 2011

(30) Foreign Application Priority Data

Oct. 5, 2007 (GB) ..... 0719530.8

(51) Int. Cl.
*A62B 18/08* (2006.01)
*A62B 7/10* (2006.01)

(52) U.S. Cl.
USPC ..... 128/206.12; 128/205.29; 128/205.27

(58) Field of Classification Search
USPC ..... 128/205.27–205.29, 206.12, 128/206.15–206.21
See application file for complete search history.

(56) References Cited

U.S. PATENT DOCUMENTS

| | | | | |
|---|---|---|---|---|
| 3,621,841 | A | 11/1971 | Austin | |
| 3,633,575 | A * | 1/1972 | Brumfield | 128/206.15 |
| 4,419,994 | A | 12/1983 | Hilton | |
| 4,630,604 | A * | 12/1986 | Montesi | 128/206.15 |
| 6,176,239 | B1 * | 1/2001 | Grove et al. | 128/206.24 |
| 6,763,830 | B1 * | 7/2004 | Davis et al. | 128/206.17 |
| 2007/0107732 | A1 * | 5/2007 | Dennis et al. | 128/206.21 |
| 2009/0217926 | A1 * | 9/2009 | Hine et al. | 128/201.25 |

FOREIGN PATENT DOCUMENTS

WO 2007042754 A 4/2007

* cited by examiner

*Primary Examiner* — Justine R Yu
*Assistant Examiner* — Rachel Young
(74) *Attorney, Agent, or Firm* — McGarry Bair PC

(57) ABSTRACT

A filtration mask has a collapsible air guide and two filter supports connected at a hinge. The filter supports are movable between a storage position and a deployment position in which the angle between the filter supports being less in the deployment position than in the storage position. In an aspect of this invention, the filter support each have a recess at the hinging edge, and an exhale valve communicating with the air guide is mounted in the recess. In another aspect the exhale valve is connected to the filter supports by a flexible membrane. In a third aspect the air guide is formed by hinged panels.

7 Claims, 17 Drawing Sheets

FILTRATION MASK

CROSS-REFERENCE TO RELATED APPLICATIONS

This application is a National Phase application of International Application No. PCT/GB2008/003320, filed Oct. 1, 2008, which claims priority to GB 0719530.8, filed Oct. 5, 2007, both of which are incorporated herein by reference in their entirety.

BACKGROUND OF THE INVENTION

1. Field of the Invention

The present invention relates to a filtration mask, such as an emergency hood.

2. Summary of the Prior Art

Filtration masks have been known for many years, and their configuration depends on their intended use. Simple filtration masks, such as surgical masks that are used by doctors or surgeons, in order to protect patients from germs contained in their breath, cover only the wearer's nose and mouth. They may be formed entirely from filtration material. Similar masks are used by wood workers and construction workers etc, to prevent dust particles entering their respiratory systems.

More complex filtration masks have been developed particularly for use in military conflicts, to provide protection for e.g. soldiers against chemical or biological hazards. These masks are often known as respirators, and usually employ a rubber mask section which covers the wearer's face, and acts as a housing for air filters. These masks must seal effectively around the face of the wearer, to ensure that no hazardous vapours can enter the wearer's respiratory system by routes other than via the air filters. The masks are often cumbersome, expensive, and must be sized to the particular wearer, in order to provide an effective seal around the periphery of the wearer's face.

Intermediate these two types of masks are emergency hoods. Emergency hoods are a type of respirator, also called an "escape hood", which are designed to assist escape from CBRN hazards, and are not intended for prolonged or repeated use. Such emergency hoods need to provide a wearer with protection for only fifteen minutes or so, preferably at least twenty minutes, to allow escape from a contaminated area. They generally comprise an oro-nasal mask, for fitting over the wearer's nose and mouth, and a hood (with neck dam) for fitting over the wearer's head. Air filters are connected to the oro-nasal mask. The hood may serve to protect the wearer's eyes and other facial, head and neck features, from hazardous chemicals.

In WO2007/042754, we disclosed such a filtration mask of respirator type, which had two filtration supports connected by an air guide containing two exhale valves, with a collapsible air guide mounted to the air guide between the filter supports. The filter supports were hinged to the air guide removable between the position in which the air guide was in a collapsed state, and the filter supports were close together to a deployed state in which the filter supports were further apart, and the air guide was deployed.

SUMMARY OF THE INVENTION

The present invention also makes use of hinged filter supports, but seeks to provide a simplified structure more adapted for an emergency hood.

In the subsequent discussions, the term "inner" will be used to refer to parts of the mask which, in use, are close to the wearer's face, and the term "outer" will be used to refer to parts which are further away from the wearer's face.

The first aspect of the invention is concerned with the positioning of the exhale valve relative to the filter supports of the filtration mask. This aspect, at its most general, the filter supports are hinged together, and the exhale valve is located within recesses in the filter supports.

Thus, according to a first aspect of the invention there may be provided a filtration mask including a collapsible air guide and two filter supports, the filter supports being hingedly connected together at hinging edges and movable between a storage position and deployment position, the hinge angle between the filter supports being less in the deployment position than the storage position, wherein the filter supports each have a recess in the corresponding hinging edge, and an exhale valve is mounted in said recesses such that the exhale valve is surrounded by the filter support when in the storage position, the exhale valve communicating with the air guide.

With this structure, the filter supports are hinged directly together, rather than being hinged to an intermediate structure as in WO2007/042754, resulting in a more complex structure. On the other hand, the exhale valve is received between the filter supports, and can be restricted volume defined by the outer and inner planes of the filter supports, when they are in the storage position, so that the mask may be compact when stored.

Preferably, the exhale valve is circular, and received between corresponding semi-circular recesses in the respective filter supports. It may form part of an exhale module, which may also be circular and be received between the recesses.

Preferably, the exhale module is connected to the filter supports by a flexible membrane. The membrane then connects the filter supports to the exhale module but permits relative movement, e.g. when the filter supports are hinged from their storage to deployment positions. The exhale module, and hence the valve, may be considered to "float" between the filter supports, because it is connected thereto by a flexible component, rather than a rigid one.

Preferably, the membrane is an annulus which is attached to a projection (e.g. an annular projection) on the inner surface of the exhale valve. The outer periphery of that annulus is then attached to the filter supports.

With such an arrangement, the exhale module may be a rigid body, but the position of that body is independent of the movement of the filter supports. Exhaled air may leave the oro-nasal cavity of the mask (within the air guide) and be expelled to the local atmosphere. The exhale valve may be positioned in the optimum position for efficient exhalation performance, whilst still allowing other parts of the mask to move. Hence, any distortion or movement of the filter supports, or other structure, is not passed on to the exhale valve. The exhale module and hence the exhale valve adopts to any orientation of the filter supports or surrounding structure, giving a high exhale efficiency. Moreover, the use of a flexible membrane offers compliance against frontal impact.

As discussed above, the use of a flexible membrane to attach the exhale module to the filter bodies has been discussed as part of the first aspect of the invention. However, it is possible for such a flexible membrane to be used independently of other features of the first aspect, and it therefore represents a second, independent, aspect of the invention.

Thus, according to the second aspect of the invention there may be provided a filtration mask including a collapsible air guide and two filter supports, the filter supports being hingedly connected together at hinging edges and movable between a storage position and deployment position, the hinge angle between the filter supports being less in the deployment position than the storage position, wherein there is an exhale module containing an exhale valve mounted between the filter supports and connected thereto by a flexible membrane, the exhale valve communicating with the air guide.

It is also desirable for the air guide to adopt a relatively compact position when the filter supports are in their storage position. In known masks, such as that disclosed in WO2007/042754, the air guide has been a integral rubber structure conforming closely to the intended shape of the face of the wearer, and is held in a collapsed position by compression. When the compressive forces are released, the air guide adopts its deployed position, the resilience of the rubber causing it to spring into shape.

The air guide may be formed by panels connected together by hinges, so that the air guide can unfold, rather than spring to shape. It is then possible for the air guide to be folded so that it is substantially flat when the filter supports are in the storage position, and the movement of the filter supports from that storage position to the deployment position may then cause the air guide to unfold, by hinging of the panels, to adopt the position which it must take when the mask is to be used. Thus, a third aspect of the invention proposes that the air guide is formed of such panels hingedly connected together. The air guide may also include a flexible face ring, connected to the panels, which will abut the wearer's face when the mask is used. Again, although such an air guide may be used in the first or second aspects of the invention, it may also be used independently of those aspects.

Hence, according to a third aspect of the invention there may be provided a filtration mask including a collapsible air guide and two filter supports, the filter supports being hingedly connected together at hinging edges and movable between a storage position and deployment position, the hinge angle between the filter supports being less in the deployment position than the storage position, wherein the air guide comprises at least four side panels and a flexible face ring being hingedly interconnected and hingedly attached to the filter supports, the face ring having an aperture therein, the air guide being foldable by hinging of the panels and the face ring between a flat position, when the filter supports are in the storage position and a deployed position when the filter supports are in the deployment position.

Preferably, the panels are of flexible material, in a similar way to the face ring, but it may be possible to make the panels of rigid material. They are normally planar.

Preferably edges of said face ring are hingedly attached to the respective filter supports.

BRIEF DESCRIPTION OF THE DRAWINGS

An embodiment of the present invention will now be described in detail, by way of example, with reference to the accompanying drawings in which.

DETAILED DESCRIPTION

Figure 1A:
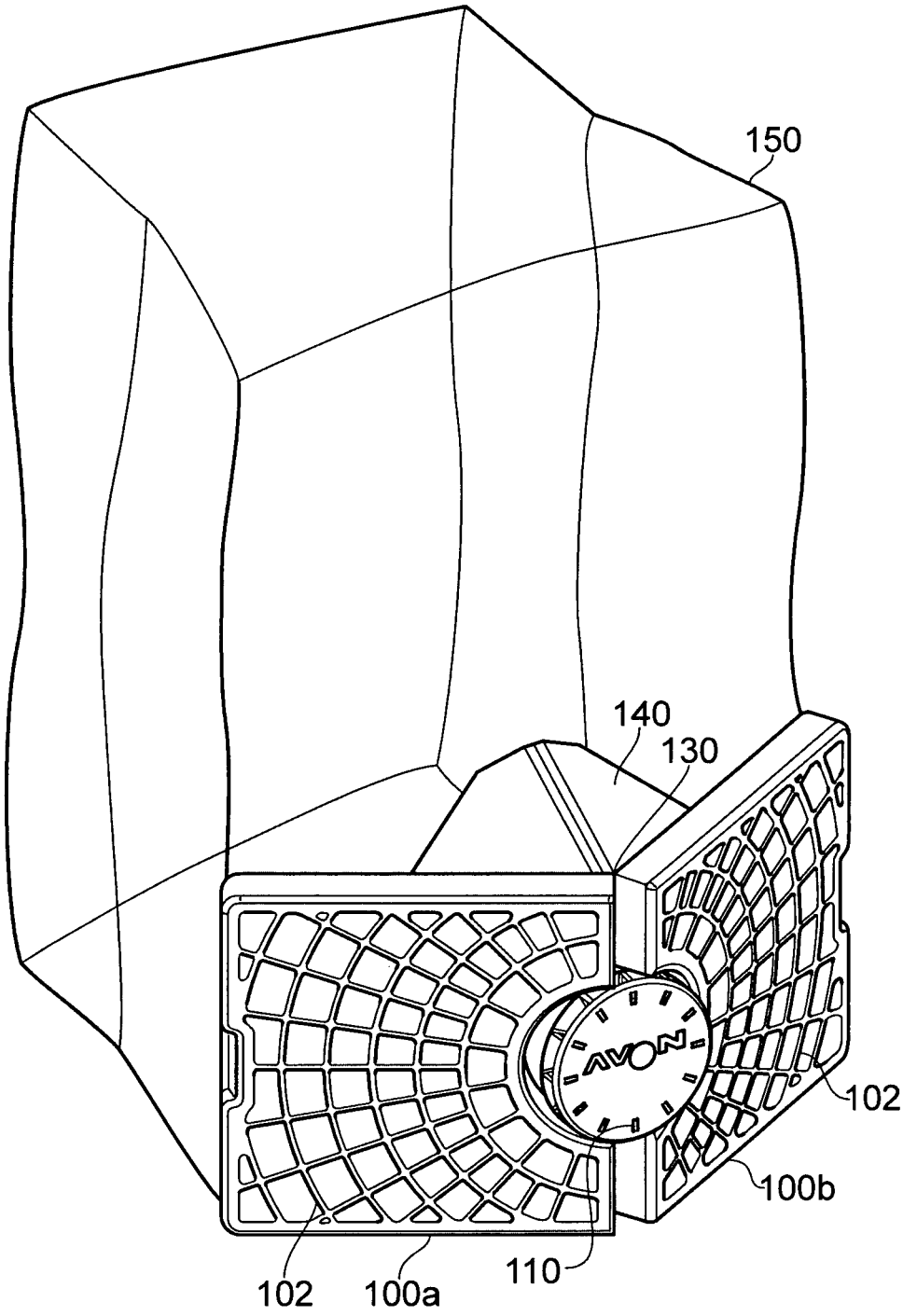
FIGS. 1*a* and 1*b* are general views of a filtration mask being an embodiment of the invention.
Figure 1B:
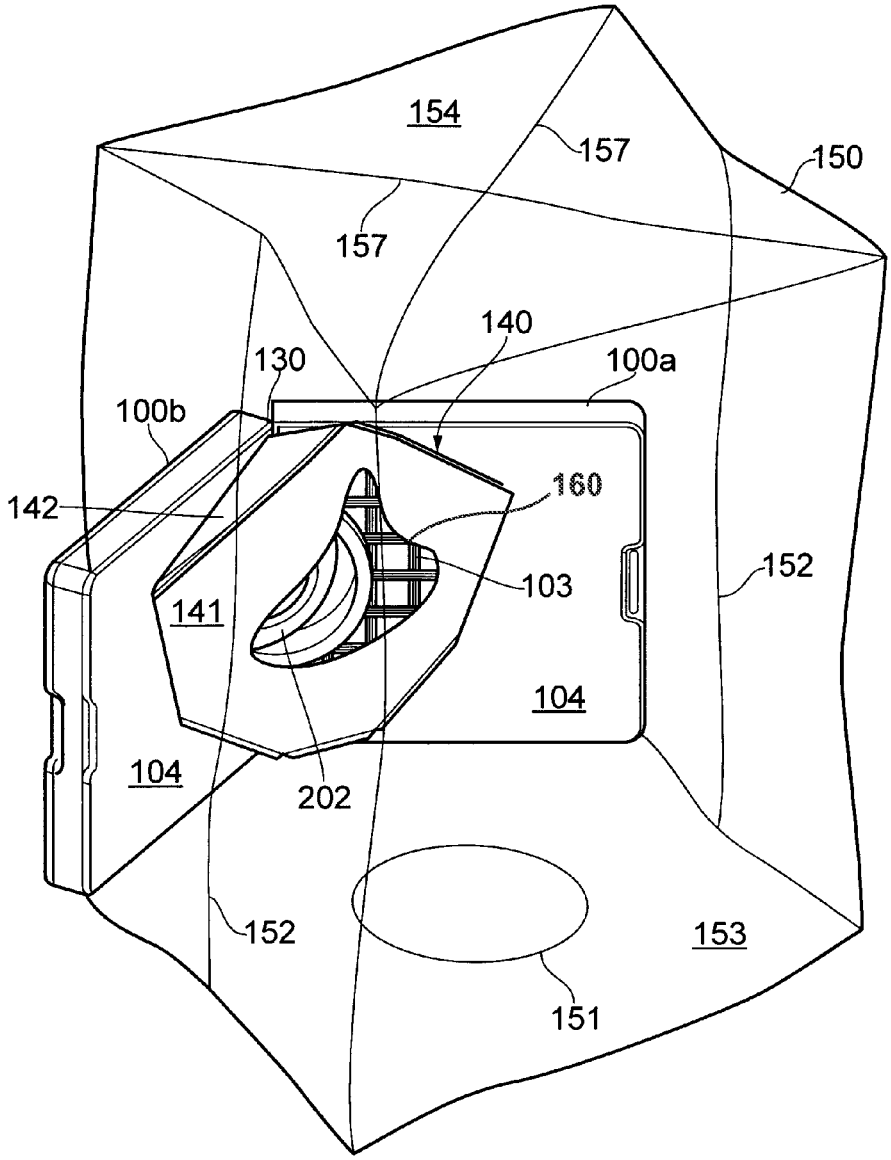

FIGS. 1*a* and 1*b* are general views of a filtration mask being an embodiment of the invention. This filtration mask is an emergency hood, also known as an escape mask.

The mask of this embodiment has five principal components. It has two filter supports 100*a*, 100*b* hingedly connected at a hinge 130. Positioned between the filter supports 100*a*, 100*b* is a circular exhale module containing an exhale valve 110. An air guide 140 is attached to the filter supports 100*a*, 100*b* and exhale module 110 and is enclosed within a hood 150 attached to the filter supports 100*a*, 100*b*.

As illustrated in FIGS. 1*a* and 1*b*, the hood 150 is transparent, so that the internal components of the mask can be seen through it. In practice, only some parts of the hood 150 are likely to be transparent, to enable the wearer to see, and other parts will be opaque for recent manufacture. The hood 150 has a hole 151 therein in its lower surface 153 to enable the wearer's head to be inserted in the mask. The hood 150 is attached to the upper and lower edges of the filter supports 100*a*, 100*b*, and also to the side edges of those filter supports 100*a*, 100*b* remote from the hinge 130.

The filter supports 100*a*, 100*b* contain filter material which remove contaminants from air inhaled into the mask. Air is exhaled through the exhale valve of the exhale module 110.

The exhale module 110 is attached to the filter supports by a flexible membrane, which is not shown in FIGS. 1*a* and 1*b*, but will be described in more detail later. However, the view of FIG. 1*b* shows a projection 202 on the exhale module 110 to which that membrane will be attached, and also shows the internal structure of the outlet path of the exhale valve within the exhale module 110. The exhale valve is within the projection 202. Similarly, FIGS. 1*a* and 1*b* show external and internal ribs 102, 103 of the filter supports 100*a*, 100*b* which hold the filter material in place.

FIG. 1*b* also shows that although parts 104 of the rear surface of the filter supports 100*a*, 100*b* are solid, the parts within the air guide 140 are open, to allow the interior of the air guide 140 to communicate with the filters and the exhale valve within the exhale module 110.

Figure 2A:
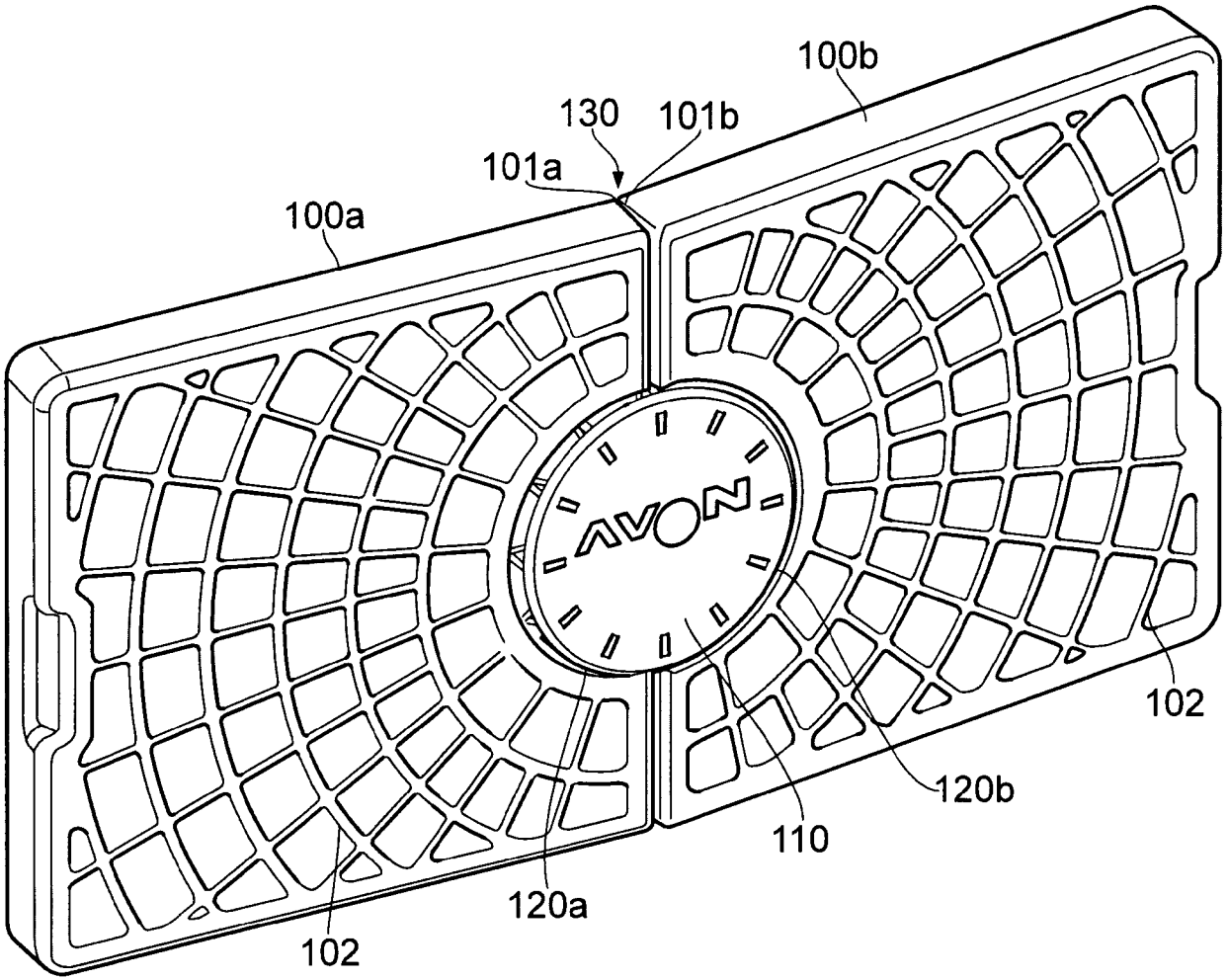
FIGS. 2*a* to 2*h* show part of the mask of FIG. 1. in successive stages of deployment.
Figure 2B:
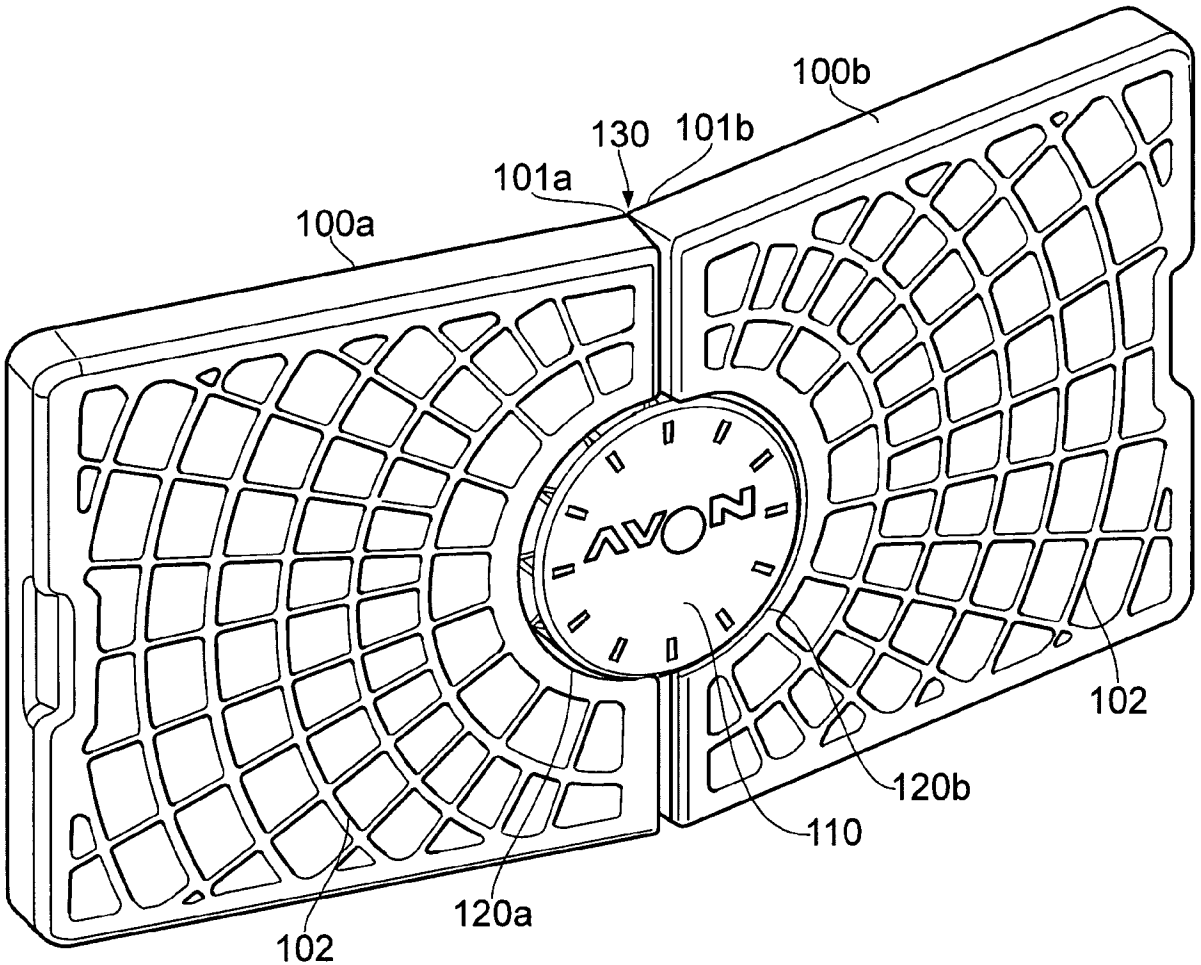
Figure 2C:
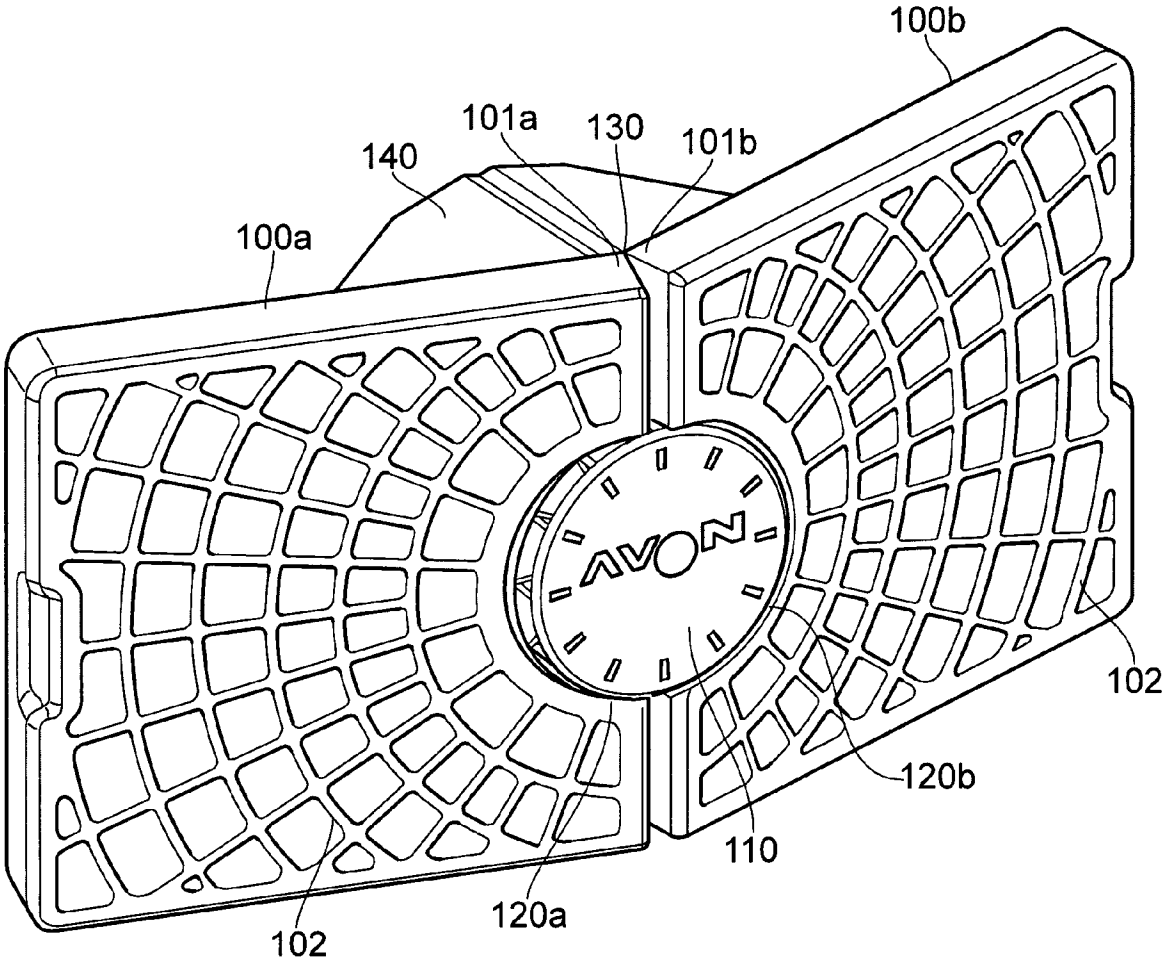
Figure 2D:
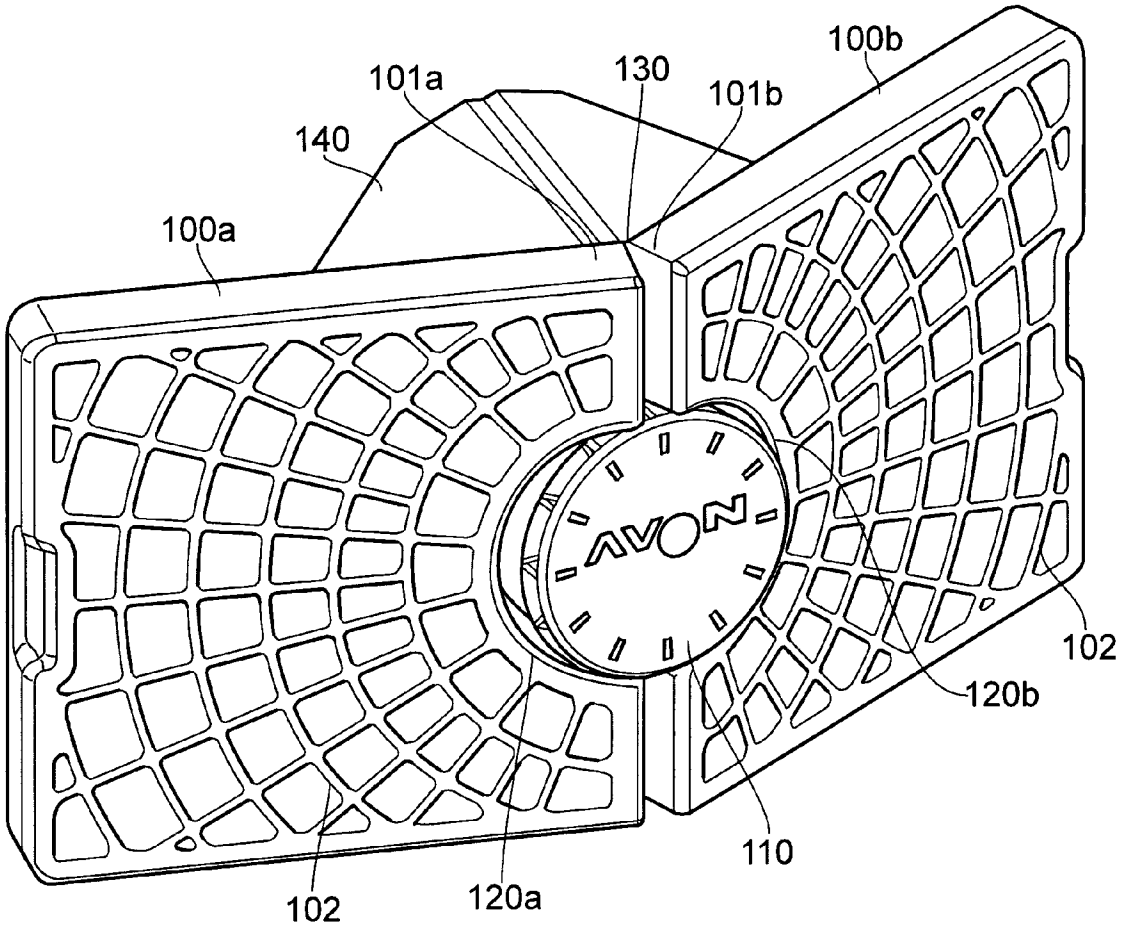
Figure 2E:
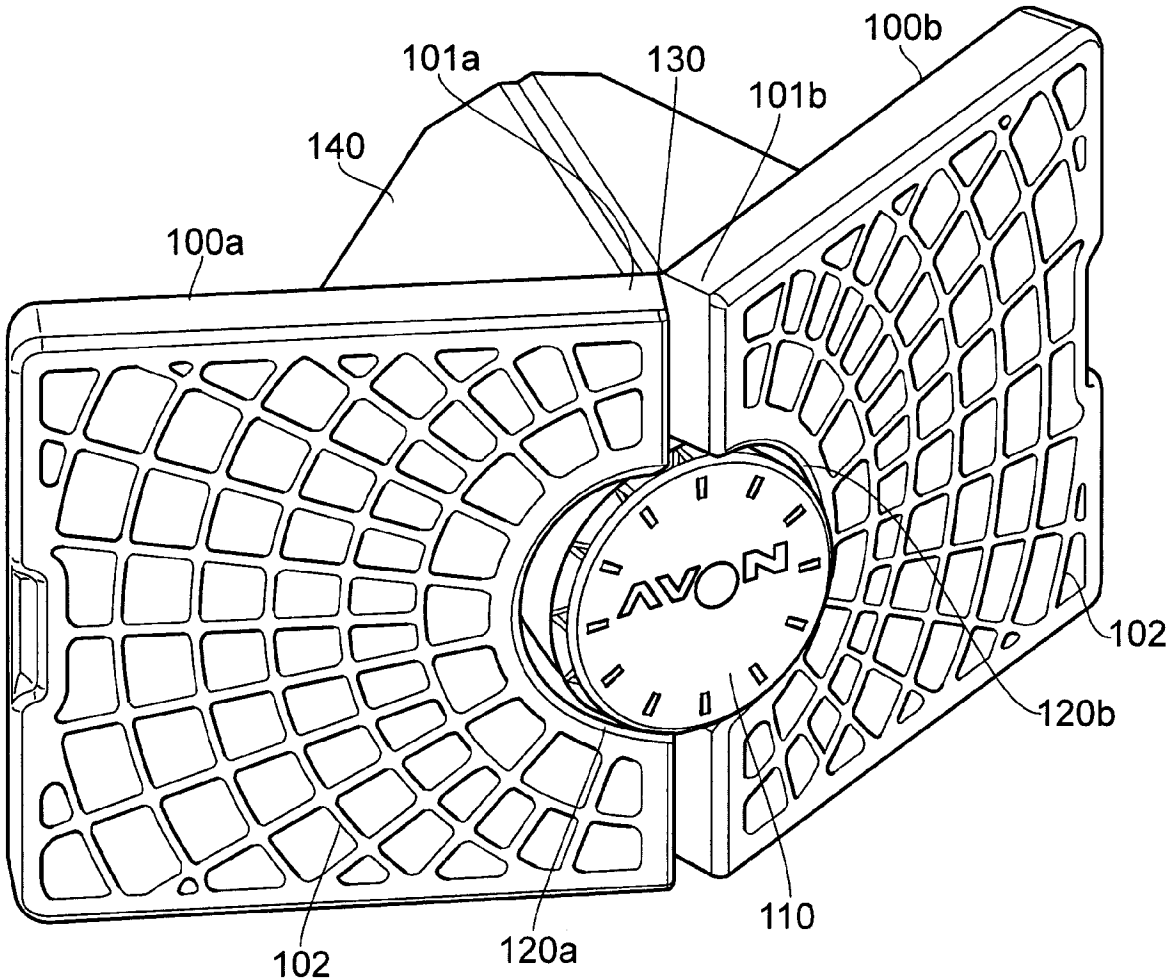
Figure 2F:
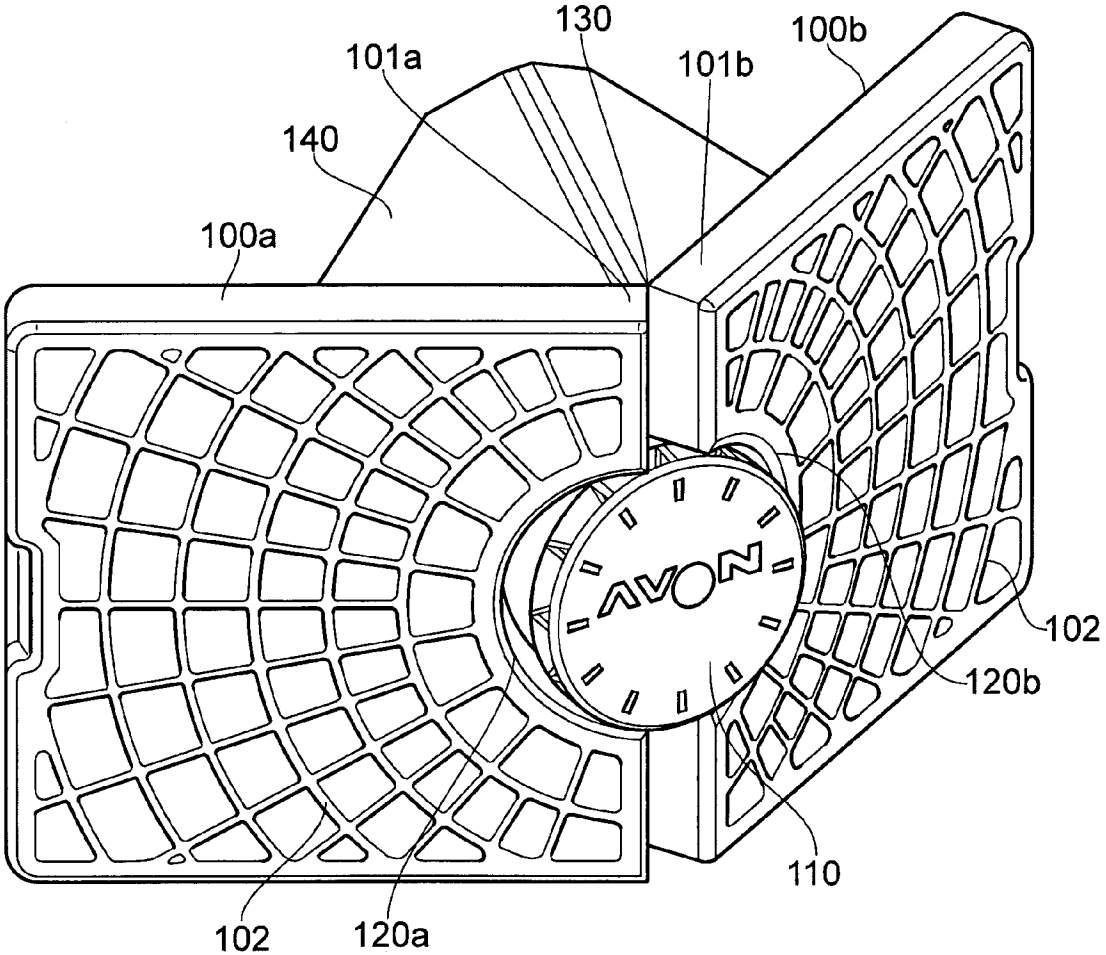
Figure 2G:
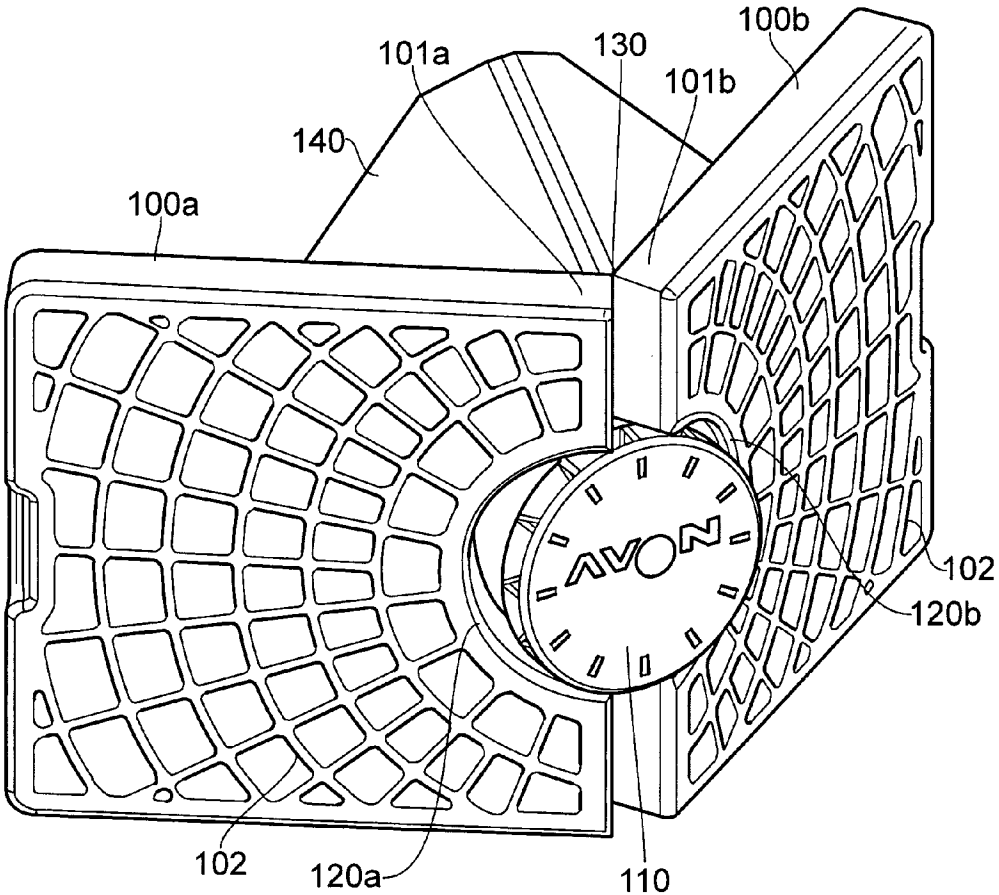
Figure 2H:
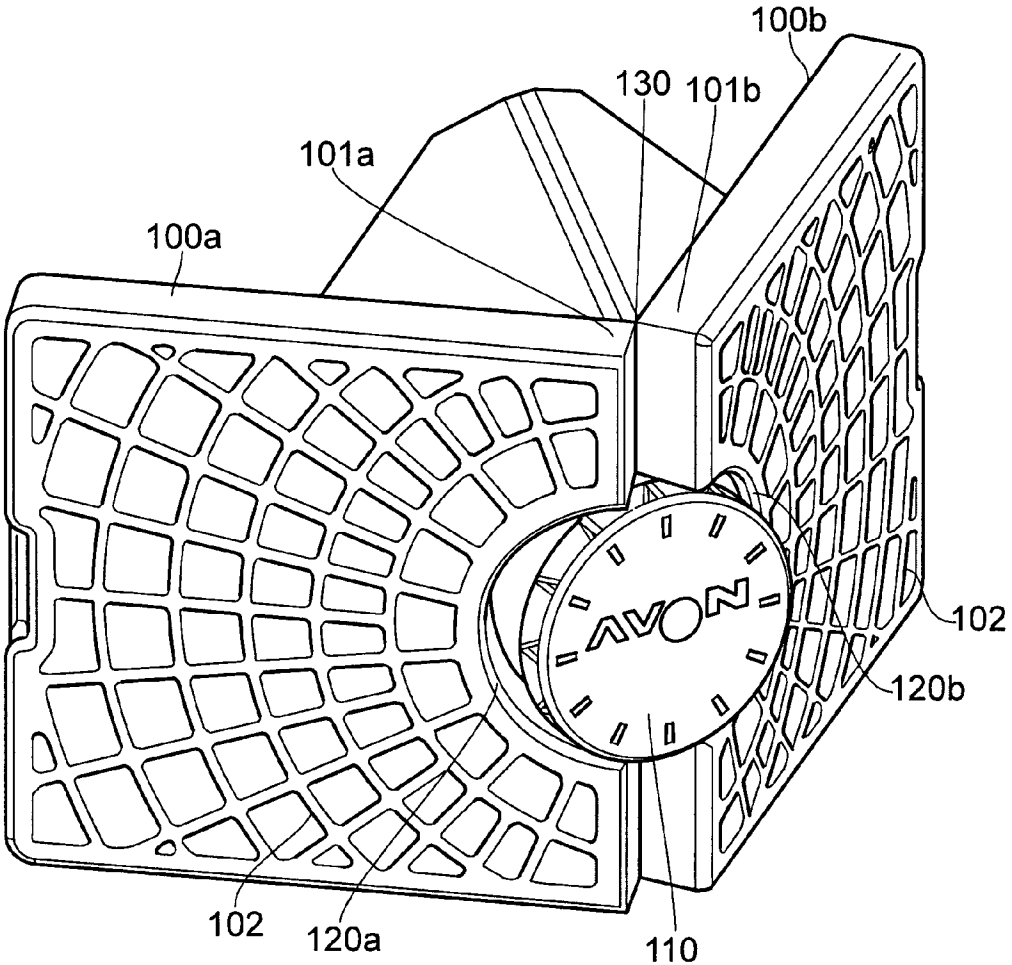

FIGS. 2*a* to 2*f* then show how the filter supports, exhale module, and air guide change in relative position as the mask is deployed. FIG. 2*a* shows the filter supports 100*a* 100*b* at, or close to, the storage position in which in this position, the circular exhale module 110 is surrounded by the semi-circular recesses 120*a*, 120*b* in the filter supports 100*a*, 100*b*.

As the mask is changed from its storage position to its deployment position, the filter supports 100*a*, 100*b* hinge along a line 130 at which their hinged edges 101*a*, 101*b* join, so that they successively adopt the position shown in FIGS. 2*b* to 2H. Note that the hinge line is at the inner edges of the filter supports 100*a*, 100*b*. The hinge angle, i.e. the internal angle between the planes of the filter supports 100*a*, 100*b* at the hinge 130 decreases as the mask is moved to its deployed position. At the same time, the air guide 140 deploys, as will be described in more detail later. Note that the reference to the "inner" planes refers to the inside surfaces of the filter supports 100*a*, 100*b* which are closest to the wearer's face, when the mask is in use.

Figure 3:
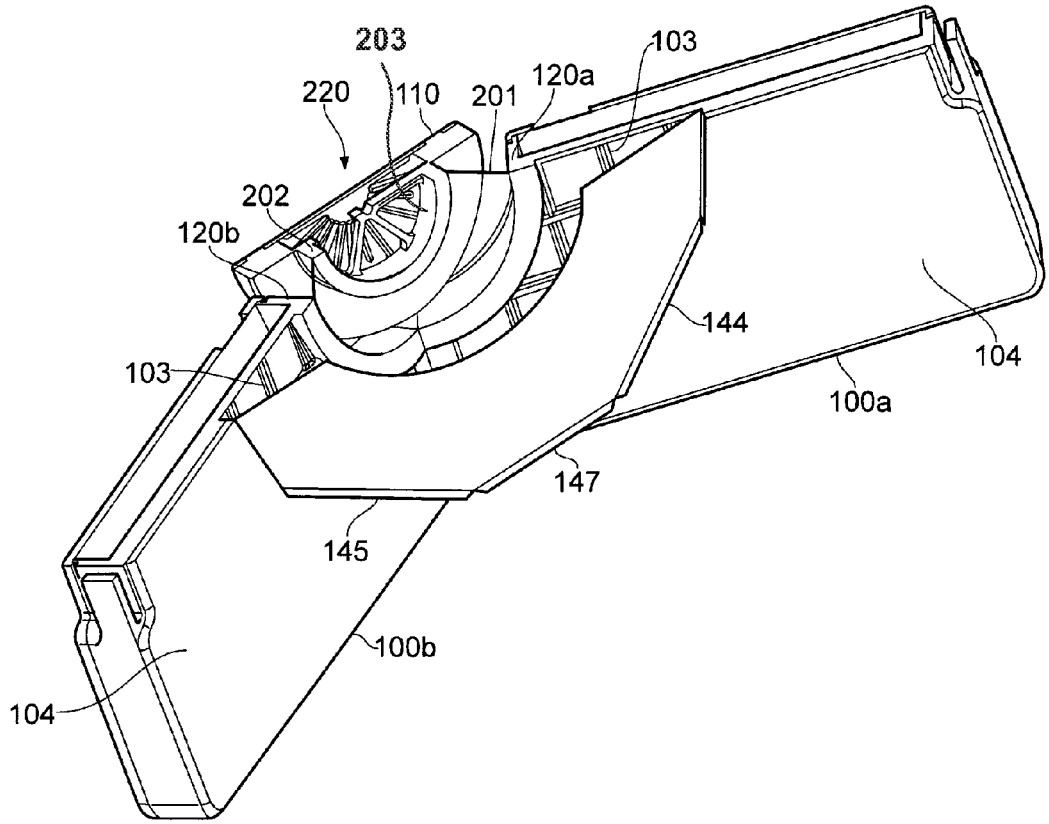
FIG. 3 is a partially exploded view of part of the mask of FIG. 1.

As can be seen from FIGS. 2*a* to 2*f*, the filter supports 100*a*, 100*b* pivot relative to the exhale module 110. It is therefore necessary to support the exhale module into position. Thus, FIG. 3 shows the attachment of the exhale valve 110 to those filter supports 100*a*, 100*b*. In FIG. 3, the parts of the air guide 140 are omitted for the sake of clarity. Thus, although panels 144, 145 and 147 of the air guide 140 are shown, other panels, and the face ring are not present in FIG. 3. The air guide 140 will be described in more detail later.

As shown in FIG. 3, the exhale module 110 is attached to the filter supports 100*a*, 100*b* by an annular membrane 201 (only part of which is visible in FIG. 3). The outer periphery of that annular membrane 201 is attached to the inner edges of the recesses 120*a*, 120*b* and its inner edge is attached to an annular projection 202 on the inner surface of the exhale module 110. The opening in the interior of that annular membrane 201 is thus aligned with the opening 203 in the exhale valve. Thus, the exhale module 110 and hence the exhale valve 220 within it can be considered to "float" between the filter supports 100*a*, 100*b*, being supported in position by the membrane 201, rather than by rigid parts of the filter supports 100*a*, 100*b*.

FIGS. 4*a* to 4*e* illustrate the deployment of the air guide. In known masks, the air guide is usually a relatively rigid structure, which is forceably collapsed when the mask is in its storage position, but which springs outward due to the resilience of the rubber material from which it is made, when the forces compressing the air guide are removed. In the present invention, on the other hand, the air guide is formed from a series of flexible panels, hingedly connected together. Thus, FIGS. 4*a* to 4*e* show that the air guide 140 comprises a flexible face ring 141 which is connected at opposite edges 141*a*, 141*b* to the respective filter supports 100*a*, 100*b*. In addition, there are four flexible and planar panels 142, 143, 144 and 145 which form the rest of the air guide. Each of those panels is hingedly connected to the face ring 141.

During the wearer's respiratory cycle, when the wearer inhales, air passes from the external atmosphere, through the filters within the filter supports 100*a*, 100*b* to the inside of the air guide 140, and then into the wearer's lungs. Then, when the wearer exhales, hot, moist air exhaled by the wearer passes into the air guide 140, then through the exhale valve 220, to the external atmosphere. The structure of this embodiment gives sufficient protection for use as an emergency hood.

Panels 142 and 143 are hingedly connected together along a hinge line 146, and panels 144 and 145 are connected by a hinging panel 147, to which they are connected by respective hinges 148, 149. FIGS. 4*a* to 4*e* also show the hinging lines 142*b*, 143*a*, 144*a* and 145*b* to which the panels 142, 143, 144 and 145 are attached to the respective filter supports 100*a*, 100*b*.

Figure 4A:
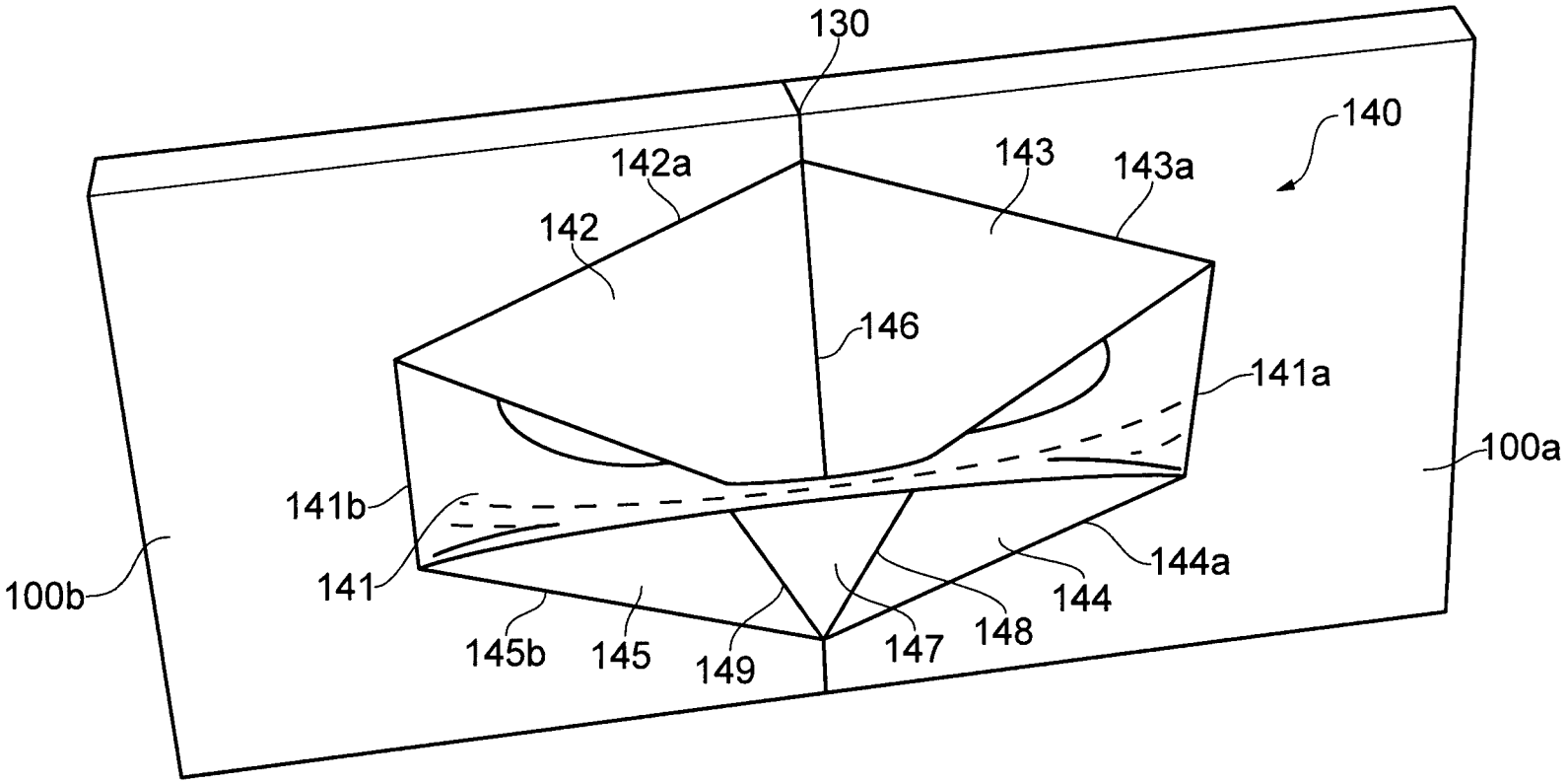
FIGS. 4*a* to 4*e* show successive stages in the deployment of the air guide of the mask of FIG. 1.
Figure 4B:
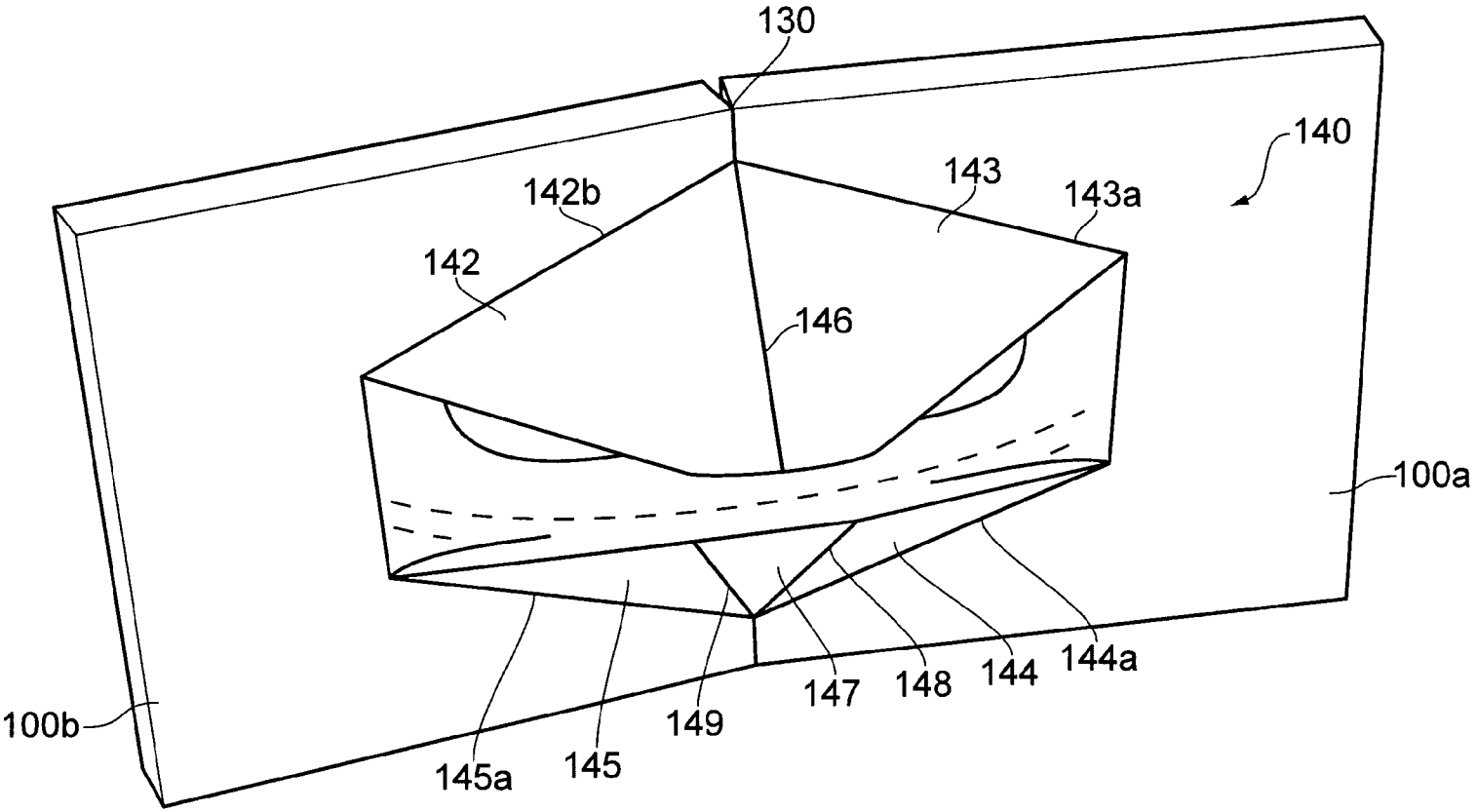
Figure 4C:
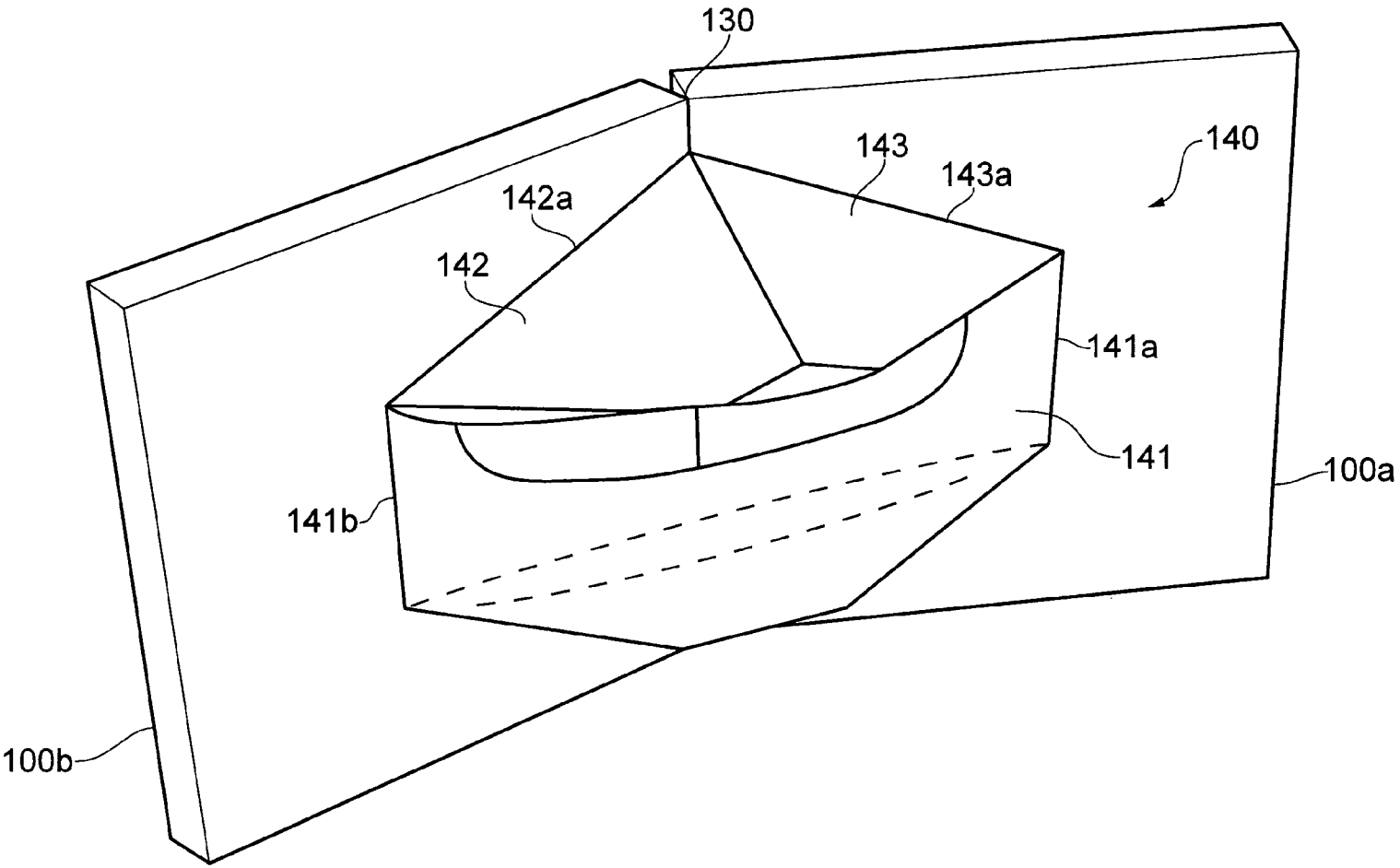
Figure 4D:
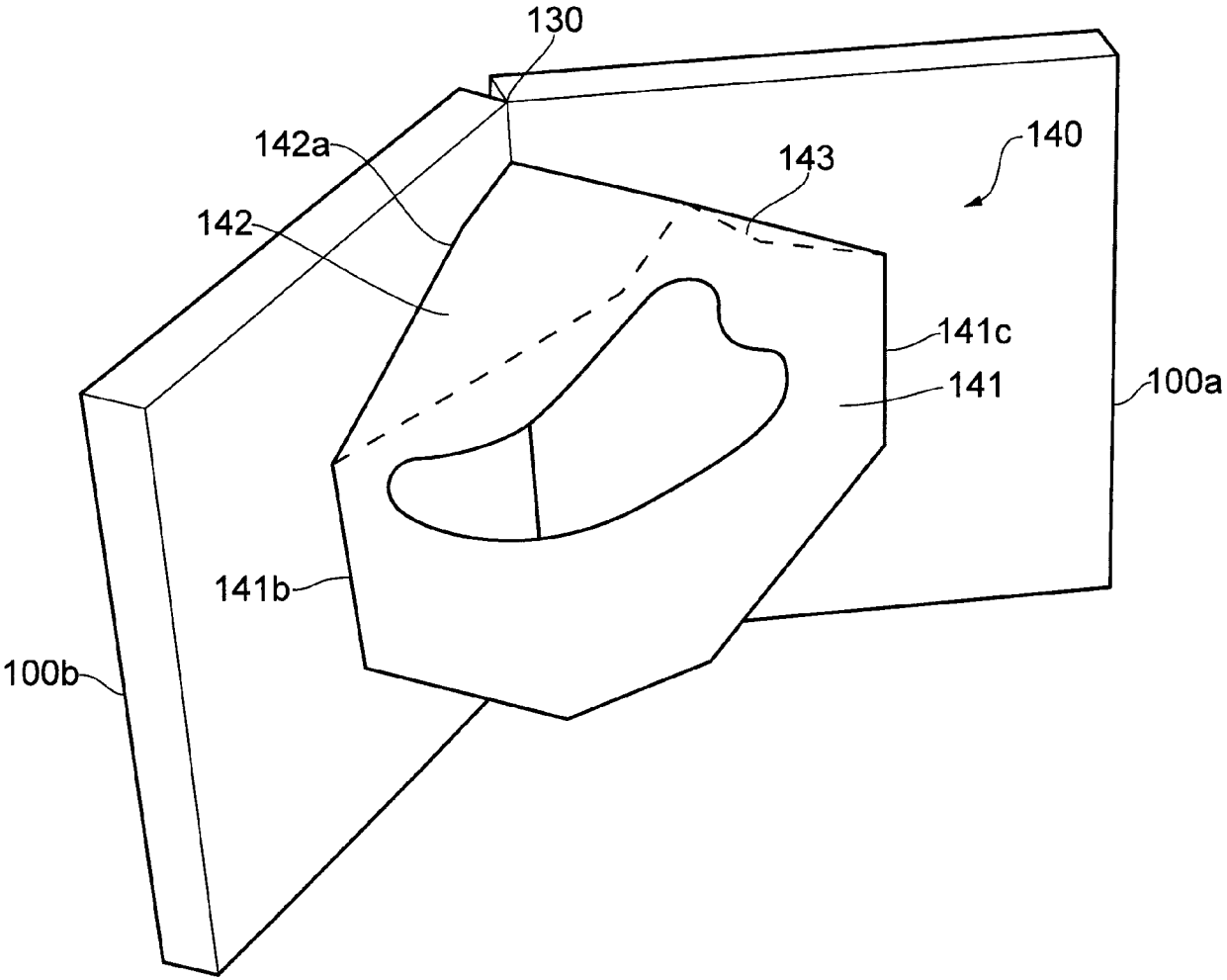
Figure 4E:
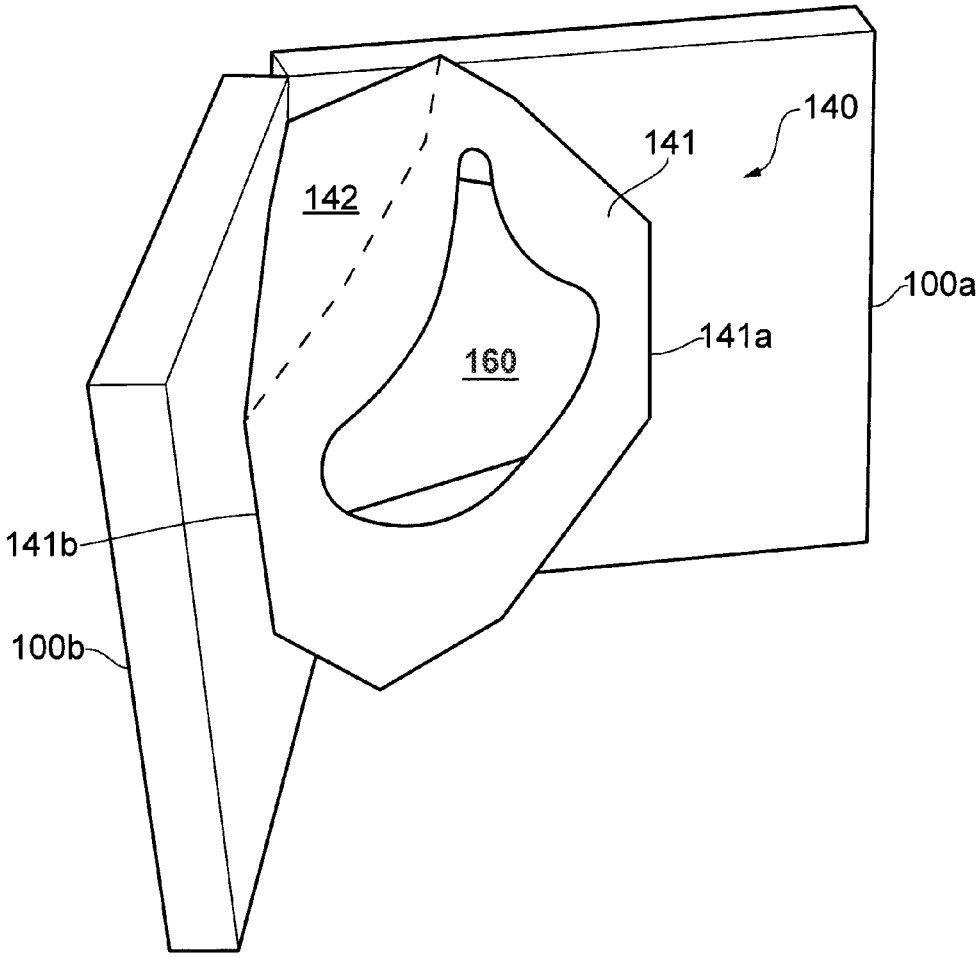

Thus, as can be seen from FIGS. 4*a* to 4*e*, the air guide unfolds from a substantially flat position, shown in FIG. 4*a*, as the filter supports 100*a*, 100*b* hinge around the hinge line 130. Two flaps, respectively formed by panels 142 and 143, and by panels 144 and 145 pivot away from the filter supports 100*a*, 100*b* and so deploy the face ring 141 to its correct position. The face ring 141, from being in a folded position in FIG. 4*a*, gradually adopts a more planar configuration, until the position shown in 4*e* is reached. At that point, the mask is ready for use. Because the face ring 141 is flexible, when the user places their nose and mouth within the opening 160 in that ring, the periphery of the opening 160 deforms to adapt to the shape of the wearer's face, and so provide sufficient sealing and efficient exhalation of hot used air.

Figures 5A, 5B, 5C:
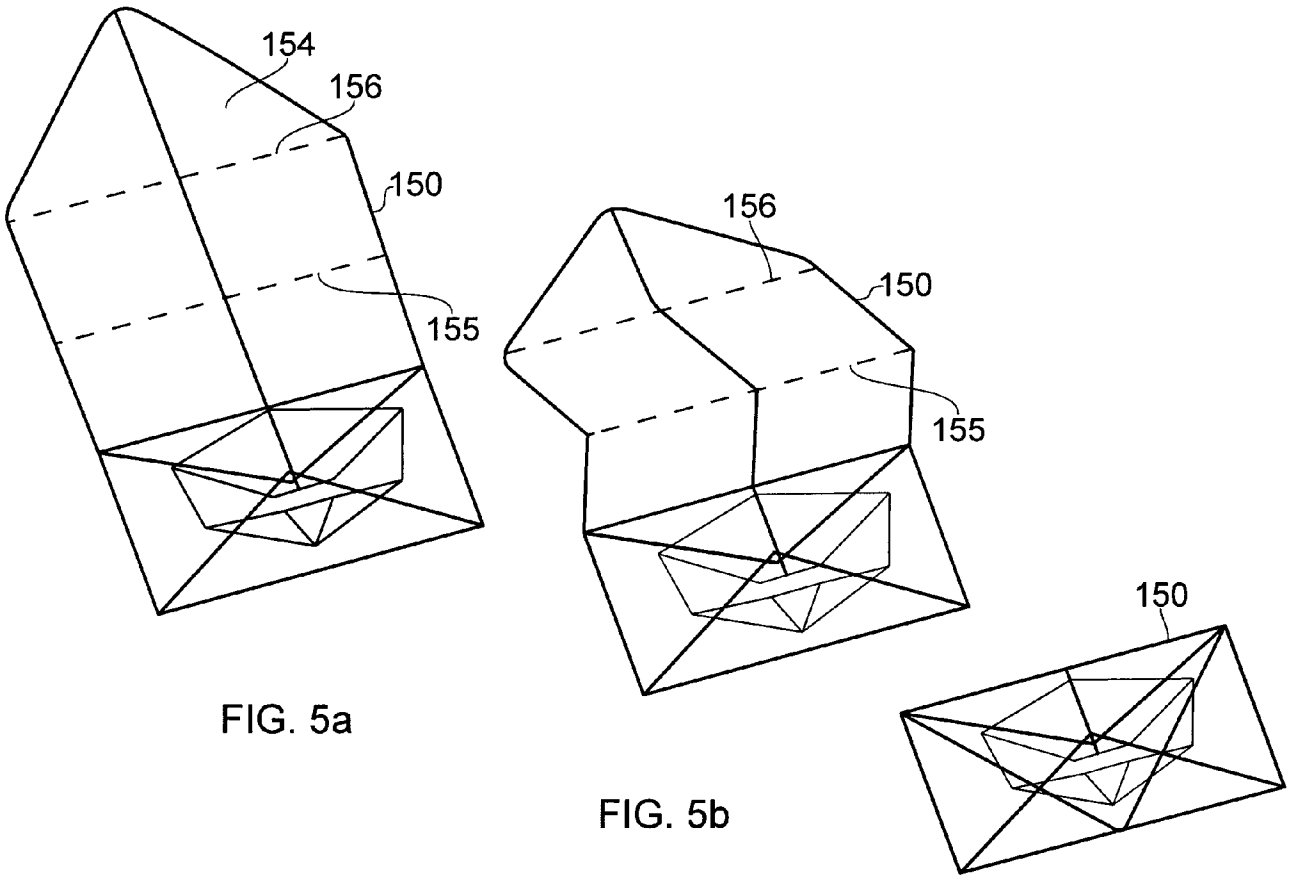
FIGS. 5*a* to 5*c* show successive stages in the folding of the hood of the filtration mask.

FIGS. 5*a* to 5*c* show the folding of the hood 150. For clarity, FIGS. 5*a* to 5*c* show successive stages in the folding of that hood, rather than the unfolding of it.

From the position shown in FIGS. 1*a* and 1*b*, the filter supports 100*a*, 100*b* are opened to the storage position in which they form a substantially flat structure (as in FIG. 2*a*) or even more flat. In that position, the air guide is also folded, in the position at FIG. 4*a*. Then, the hood 150 is flattened, by folding the sides inwardly, hinging around the lines 152 in FIG. 1*b*, and with the lower surface 153 of the hood (the surface which contains the hole 151) also folded against the filter supports 100*a*, 100*b*. The top 154 of the hood 150 adopts the pointed shape shown in FIG. 5*e*, folding along fold lines 153 shown in FIG. 1*b*.

From that position, the hood is then folded transversely along fold lines 155 and 156 as shown in FIG. 5*b*, until those folds 155, 156 are at 180°, at which point the hood wholly overlies the filter supports 100*a*, 100*b*, and the position shown in FIG. 5*c* is reached. This is the position in which the mask can be packaged for storage and/or transport.

To deploy the hood, the procedure shown in FIGS. 5*a* to 5*c* is reversed, until the hood 150 reaches the position shown in FIGS. 1*a* and 1*b*. The filter supports 100*a*, 100*b* can then be folded to the deployed position as described with reference to FIGS. 2*a* to 2*h*, and the air guide unfolded as described with reference to FIGS. 4*a* to 4*e*. The mask is then ready for use.

Thus, the embodiment described above provides a filtration mask adapted for use as an emergency hood. When the various elements are in the storage position, it presents a small package which can e.g. fit into the pocket of the user. It may be made light weight, from suitable choice of materials. However, when needed it may rapidly be unfolded to adopt the deployment position, where it is ready for wear.

The invention claimed is:

1. A filtration mask including a collapsible air guide and two filter supports, the filter supports being directly, hingedly connected together at hinging edges and moveable between a storage position, wherein the filter supports lie in a common plane, and a deployment position, wherein the included hinge angle between the filter supports is less than 180°, wherein the air guide comprises at least four side panels and a flexible face ring being hingedly interconnected and hingedly attached to the filter supports, the face ring having an aperture therein, the air guide being foldable by hinging of the panels and the face ring between a flat position against the filter supports, when the filter supports are in the storage position and a deployed position when the filter supports are in the deployment position; wherein the filter supports each have a recess in the corresponding hinging edge, and an exhale valve is mounted in said recesses such that the exhale valve is surrounded by the filter supports when in the storage position, the exhale valve communicating with the air guide; wherein the filtration mask folds to an essentially flat configuration when filter supports are in a storage position and the air guide unfolds to a deployed position when the filter supports are in the deployment position.

2. A filtration mask according to claim 1, wherein the panels are flexible.

3. A filtration mask according to claim 1, wherein the panels are planar.

4. A filtration mask according to claim 1, wherein edges of said face ring are hingedly attached to the respective filter supports.

5. A face mask according to claim 1, wherein the exhale valve is an exhale module connected to the filter supports by a flexible membrane.

6. A face mask according to claim 1, wherein each of said recesses is semi-circular.

7. A face mask according to claim 1, wherein the exhale valve is circular.

* * * * *